US006230680B1

(12) United States Patent
Pirone

(10) Patent No.: US 6,230,680 B1
(45) Date of Patent: May 15, 2001

(54) HIGH-PRECISION THREE-VALVE MOTORCYCLE ENGINE LUBRICATION

(76) Inventor: Thomas A Pirone, 43 Lamppost Rd., West Redding, CT (US) 06896

( * ) Notice: Subject to any disclaimer, the term of this patent is extended or adjusted under 35 U.S.C. 154(b) by 0 days.

(21) Appl. No.: 09/504,475

(22) Filed: Feb. 16, 2000

(51) Int. Cl.[7] ..... F01M 1/00
(52) U.S. Cl. ..... 123/196 R; 184/6.13
(58) Field of Search ..... 123/196 R; 184/6.9, 184/6.13

(56) References Cited

U.S. PATENT DOCUMENTS

| | | | |
|---|---|---|---|
| 2,263,414 | 11/1941 | Beneshek et al. | 123/196 R |
| 2,453,217 | 11/1948 | Gregg et al. | 184/6.13 |
| 2,458,763 | 1/1949 | Birmann | 184/6.13 |
| 5,937,817 | 8/1999 | Schanz et al. | 123/196 AB |

OTHER PUBLICATIONS

Webster and Putnam, Motorcycle Operation and Service, 1986, pp. 177–187.
Johns, Edmundson, Scharff, Motorcycles, Fundamentals, Service and Repair, 3rd ed. 1999, pp. 234–242.
Motorcycle Mechanics Institute, The Complete Guide to Motorcycle Mechanics, 2nd ed., 1994, pp. 28–35; 42–43; 134–136.

*Primary Examiner*—Noah P. Kamen
(74) *Attorney, Agent, or Firm*—Ware Fressola Van Der Sluys & Adolphson LLP

(57) ABSTRACT

Highly reliable lubrication and cooling of four-stroke cycle motorcycle engines are achieved by an oil pump and three check valve assembly delivering oil continuously to tappets at the upper end of the cylinders. Engine operation at idling speed or higher produces oil pump pressure exceeding about 12 psi, and the crankshaft bearings are thus continuously lubricated as well. "Wet sump" collection of oil in the crankcase is avoided, and effective cooling of return oil in an external oil tank promotes cooler engine operation.

4 Claims, 1 Drawing Sheet

HIGH-PRECISION THREE-VALVE MOTORCYCLE ENGINE LUBRICATION

Figure 1:
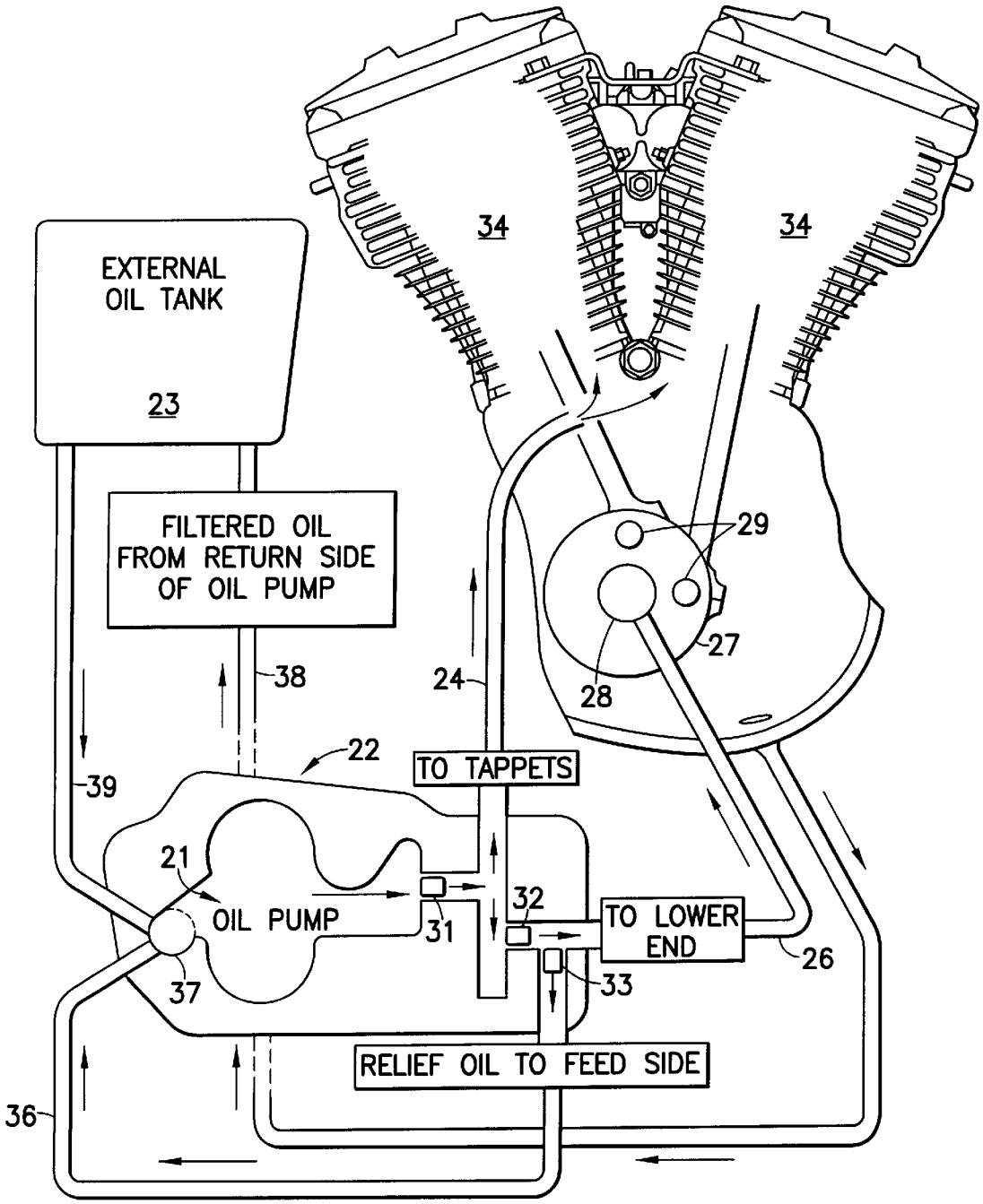

This invention relates to lubrication systems for four-stroke cycle motorcycle engines, and particularly to lubrication systems not relying only on wet sump splash or drip lubrication to supply lubricating oil to crankshaft main bearings and connecting rod bearings.

RELATED ART

Conventional motorcycle engines have employed splash lubrication of "wet sump" oil collected in the crankcase to lubricate main bearings and connecting rod bearings on the crankshaft. When starting cold, this oil exhibited high viscosity, making the engine hard to start.

Moreover, such conventional engines customarily incorporated two inexpensive check valves for controlling the flow of oil, with inadequate results. These check valves normally incorporate roughly fabricated seats, which may have rough spots or burrs preventing reliable check valve seating. A first check valve receiving oil pump output is nominally set to open at about 3 psi, but inadequate seating allows it to leak oil constantly to the tappets or valve guides and the cylinder walls. Faulty operation of the first check valve often prevents a second plunger type check valve from reaching its nominal opening pressure of about 40 psi, thus preventing adequate lubricating oil from reaching the crankshaft bearings. The connecting rod crankshaft bearings are generally roller bearings, to carry maximum loads, and inadequate or intermittent lubrication often causes premature failure of these bearings.

BRIEF SUMMARY OF THE INVENTION

The present invention employs three high precision ball check valves, fabricated of stainless steel with smoothly honed check valve seats. High precision check valve springs permit precise control of valve opening pressures and assure adequate lubrication even when the engine is idling.

Accordingly, a principal object of the invention is to provide reliable lubrication of the motorcycle engine at all engine speeds, producing low friction operation, successful scavenging of lubricated surfaces and satisfactory cooling.

Another object is to provide a steady stream of oil at 8 to 12 psi to the crankshaft bearings, regardless of engine speed.

Oil supplied to the crankpin and connecting rods also supplies oil to the pistons and cylinders, drastically reducing cylinder temperatures, and still another object is to assure that such cooling is reliably achieved.

Other objects of the invention will in part be obvious and will in part appear hereinafter.

The invention accordingly comprises the features of construction, combinations of elements, and arrangements of parts which will be exemplified in the construction hereinafter set forth, and the scope of the invention will be indicated in the claims.

THE DRAWINGS

For a fuller understanding of the nature and objects of the invention, reference should be made to the following detailed description taken in connection with the accompanying drawings, in which:

FIG. 1 is a schematic diagram of the present invention with its three high precision ball check pressure control valves.

BEST MODE FOR CARRYING OUT THE INVENTION

As shown in the FIGURE, the oil pump 21 is mounted in oil pump housing 22, positioned in the base of a V-Twin four stroke cycle motorcycle engine. A so-called "wet sump" of lubricating oil in the crankcase is not employed. Instead the oil pump's return side draws surplus oil from the crankcase, and after filtering, returns it to external oil tank 23.

High-precision oil pressure control ball check valves 31, 32 and 33 are shown mounted in suitable passageways formed in oil pump housing 22.

Valves 31, 32 and 33 are all stainless steel valves, with smooth seats and carefully selected springs, providing precise "cracking" pressures:

| Valve | Preferred Range | Most Preferred |
|---|---|---|
| 31 | 2 to 8 psi | about 6 psi |
| 32 | 9 to 15 psi | about 12 psi |
| 33 | 30 to 40 psi | about 36 psi |

Valve 31 with a preferred cracking pressure of about 6 psi is interposed directly in the oil pump's delivery portal, preventing backflow of previously delivered oil when the engine is not running.

Oil delivered by check valve 31 is directed by upper end conduit 24 to the upper portion of the engine, to assure adequate lubrication of tappets or valve guides.

When oil pump delivery pressure exceeds the cracking pressure of check valve 32, preferably about 12 psi, oil is delivered by lower end conduit 26 to the crankshaft 27, assuring adequate lubrication of main bearings 28 and connecting rod bearings 29. Excess oil passing through these bearings may be splashed by the crankshaft into the interior surfaces of cylinders 34, and excess oil reaching the bottom of the crankcase is drawn into the low pressure return side of the oil pump, and is returned after filtering directly to external oil tank 23.

If oil pump 21 produces a delivery pressure exceeding the cracking pressure of check valve 33, about 36 psi, oil passing through this valve 33 is carried therefrom via relief conduit 36 directly to the feed intake portal 37 of oil pump 21.

Thus the present invention achieves successful lubrication of tappets, cylinders and pistons, the crankshaft bearings and nearby splash surfaces via upper conduit 24 and via lower end conduit 26; the combination of all three high precision ball check valves 31, 32 and 33 eliminates the wet sump in the crankcase, and provides more effective cooling of the returned oil in the external oil tank 23.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An oil pump and control check valve assembly for a four stroke cycle motorcycle engine having a crankcase, a crankshaft with bearings, and tappets or valve guides at the upper end of combustion cylinders, comprising:

an oil pump housing incorporating a feed portal, a high pressure delivery portal, and a high pressure oil pump between said portals;

a low pressure return oil pump also incorporated in said housing, a delivery check valve mounted in said high pressure delivery portal having a predetermined cracking pressure, an upper delivery conduit delivering oil from said delivery check valve to the tappets at the upper end of the motorcycle engine, means forming a passage in said oil pump housing connecting the high pressure delivery portal to a second check valve having an intermediate cracking pressure, a lower delivery conduit connecting said second check valve to the crankshaft bearings of said motorcycle engine, a third relief check valve connecting said lower delivery conduit to the oil pump's feed portal and having a cracking pressure higher than said intermediate cracking pressure, a return oil conduit connecting the engine's crankcase to said low pressure return oil pump, and an external oil tank having an intake conduit delivering oil to said tank from said low pressure return oil pump, and having an oil feed conduit delivering oil from said tank to the feed portal of said oil pump housing.

2. The oil pump and control check valve assembly defined in claim 1, wherein the delivery check valve, the second check valve and the third relief check valve are all provided with smooth check valve seats, minimizing leakage of all three check valves.

3. The oil pump and control check valve assembly defined in claim 1, wherein the preferred cracking pressures of the three check valves are between about 2 psi and about 8 psi for the delivery check valve, between about 9 psi and about 15 psi for the second check valve, and between about 30 psi and about 40 psi for the third relief check valve.

4. The oil pump and control check valve assembly defined in claim 1, wherein the preferred cracking pressures for the three check valves are:

about 6 psi, for the delivery check valve, about 12 psi, for the second check valve, and about 36 psi, for the third relief check valve.

* * * * *